US007695381B1

(12) United States Patent
Sullivan et al.

(10) Patent No.: US 7,695,381 B1
(45) Date of Patent: Apr. 13, 2010

(54) GOLF BALL WITH HIGH MOISTURE BARRIER PROPERTIES

(75) Inventors: Michael J. Sullivan, Fairhaven, MA (US); Murali Rajagopalan, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/333,877

(22) Filed: Dec. 12, 2008

(51) Int. Cl.
*A63B 37/06* (2006.01)

(52) U.S. Cl. ..... 473/378

(58) Field of Classification Search ..... 473/378, 473/351

See application file for complete search history.

(56) References Cited

U.S. PATENT DOCUMENTS

| | | | | |
|---|---|---|---|---|
| 3,264,272 | A | 8/1966 | Rees et al. | 260/78.5 |
| 4,351,931 | A | 9/1982 | Armitage | 526/227 |
| 5,334,673 | A | 8/1994 | Wu | 273/235 |
| 5,484,870 | A | 1/1996 | Wu | 528/28 |
| 5,688,191 | A | 11/1997 | Cavallaro | 473/373 |
| 5,692,974 | A | 12/1997 | Wu et al. | 473/377 |
| 5,820,488 | A | 10/1998 | Sullivan et al. | 473/374 |
| 5,849,168 | A | 12/1998 | Lutz | 264/755 |
| 5,908,358 | A | 6/1999 | Wu | 473/361 |
| 5,919,862 | A | 7/1999 | Rajagopalan | 525/63 |
| 6,180,040 | B1 | 1/2001 | Ladd et al. | 264/248 |
| 6,180,722 | B1 | 1/2001 | Dalton et al. | 525/193 |
| 6,207,784 | B1 | 3/2001 | Rajagopalan | 528/71 |
| 6,386,992 | B1 | 5/2002 | Forte et al. | 439/676 |
| 6,503,156 | B1 | 1/2003 | Sullivan et al. | 473/374 |
| 6,506,130 | B2 | 1/2003 | Sullivan et al. | 473/374 |
| 6,756,436 | B2 | 6/2004 | Rajagopalan | 524/322 |
| 6,835,794 | B2 | 12/2004 | Wu et al. | 528/64 |
| 7,306,528 | B2 | 12/2007 | Jordan | 473/376 |
| 2003/0100656 | A1 * | 5/2003 | Majumdar et al. | 524/445 |
| 2006/0189412 | A1 * | 8/2006 | Sullivan et al. | 473/370 |

OTHER PUBLICATIONS

U.S. Patent Publication No. 2002/0013413.
U.S. Patent Publication No. 2003/0130434.
U.S. Patent Publication No. 2001/0018375.
U.S. Patent Publication No. 2001/0019971.
U.S. Patent Publication No. 2003/0199337.
Jeff Dalton, Compression by any Other Name, Science and Golf IV, Proceedings of the World Scientific Congress of Golf (Eric Thain ed., Routledge, 2002).

* cited by examiner

*Primary Examiner*—Raeann Trimiew
(74) *Attorney, Agent, or Firm*—Hanify & King, P.C.

(57) ABSTRACT

Golf balls including at least one layer formed from high moisture barrier nanocomposite compositions that generally include a thermoplastic polymer and an intercalated clay that have increased moisture resistance.

20 Claims, No Drawings

GOLF BALL WITH HIGH MOISTURE BARRIER PROPERTIES

FIELD OF THE INVENTION

The present invention relates to compositions for golf balls that include high moisture barrier nanocomposite compositions. In particular, the compositions of the invention, which generally include a polymer resin and an intercalated clay, have the benefit of increased moisture resistance without a concomitant decrease in ball performance. The compositions of the invention may be used in any layer of a golf ball, e.g., an outer cover layer or inner cover layer, or may be used as a coating to be disposed over a structural outer layer of a golf ball.

BACKGROUND OF THE INVENTION

Golf ball manufacturers have been experimenting with various materials and manufacturing methods for golf balls over the years in an attempt to improve overall performance and durability and to further refine the manufacturing process.

Golf ball manufacturers have also attempted to address durability and performance issues by manipulating the materials used to form the core and cover layers of golf balls. For example, manufacturers use ionomer resins to form golf ball covers because of the durability, rebound, and scuff resistance characteristics of the materials. However, while ionomer resins are more durable than other types of golf ball layer materials, the same properties that result in durability also provide a hard "feel" and generally result in a lower spin rate and, thus, lower control, due to the hardness of the material.

Alternatively, polyurethane compositions produce "soft" covers and typically allow for greater control because of the increased spin. Because conventional polyurethane cover materials are typically formed of aromatic components, the ultraviolet degradation of the material, which leads to yellowing, led to the recent trend toward light stable cover materials, such as aliphatic polyurethane and polyurea materials. Whether aromatic or aliphatic in nature, however, the relative softness of the polyurethane and polyurea materials, as compared to, for example, ionomer resins, introduces durability issues. In addition, when the inner cover layer of a golf ball is formed from an ionomer resin and the outer cover layer is formed from polyurethane or polyurea, adhesion between the layers is a concern. In an effort to remedy potential delamination of the layers, the inner components of most commercially available polyurethane- or polyurea-covered golf balls are surface treated, e.g., corona discharge/silane dipping, to overcome the adhesion problems. The surface treatment, however, adds cost and time to the manufacturing process.

Further attempts to compensate for the "hard" feel of ionomer-covered golf balls and durability and adhesion issues with polyurethane-covered and polyurea-covered golf balls have resulted in blends of hard ionomer resins, i.e., resins with hardness values of about 60 Shore D and above, with relatively softer polymeric materials. For example, blends of hard ionomers with polyurethanes have been used to form intermediate layers and cover layers of golf balls. However, such blends generally have processing difficulties associated with their use in the production of golf balls due to the incompatibility of the components. In addition, golf balls produced from these incompatible mixtures will have inferior golf ball properties such as poor durability, cut resistance, and the like.

There are many similar examples of materials that have beneficial qualities to golf ball manufacturers, but, because of certain detrimental qualities, cannot be used independently of other more conventional materials. For example, a material with poor moisture resistance, poor durability, or low resiliency would not be useful on its own to form a layer of a golf ball. These types of materials are generally blended with other materials or not used at all.

Additionally, water absorption represents a major hurdle for golf ball manufacturers seeking to increase golf ball durability without affecting golf ball performance. The characteristics of a golf ball can change significantly during a short period of time if the ball absorbs moisture. Such moisture absorption may affect the weight of the ball, as well as the physical and mechanical characteristics of the various materials that make up the different pieces of the golf ball structure, including the cover, the core and the mantle.

While certain polyols or polyamines provide more stability to a polyurethane or polyurea material in terms of moisture resistance, polyurethanes remain highly susceptible to changes in their physical properties due to absorption of moisture. To avoid moisture absorption, manufacturers have attempted to use moisture barrier layers, e.g., U.S. Pat. No. 5,820,488, located between the core and the cover. U.S. Pat. No. 7,306,528 discloses a thin film forming a moisture vapor barrier between the core and the cover of the golf ball with a moisture vapor transmission rate preferably lower than that of the cover to decrease the amount of moisture penetrating into the core of the golf ball.

However, there still remains a need for materials that are resistant to absorption of moisture suitable for forming a golf ball component in a way that capitalizes on the beneficial nature of the material while at the same time minimizing or completely overcoming the detrimental qualities. For example, it would be advantageous to form a golf ball layer or coating from a composition that incorporates modified organic clays or the like to take advantage of the beneficial properties of the clay that exhibit increased water resistance and better performance characteristics, greater exfoliation, and enhanced mechanical strength than conventional nanoclay compositions. In addition, golf balls having structural and/or coating layers formed, at least in part, from such compositions would be advantageous.

SUMMARY OF THE INVENTION

The present invention is directed to a golf ball including a core and a cover, wherein the cover is formed from a composition including: an intercalated clay, wherein the clay has been organically modified through a reaction with at least one surfactant including a plurality of alkyl tails on an ammonium ion; and a thermoplastic polymer.

The intercalated clay may be selected from the group including a methyl trihexadecyl ammonium montmorillonite, bis(2-hydroxy-ethyl)methyl ammonium montmorillonite, trimethyl tallow quaternary ammonium montmorillonite, methyl bis(hydrogenated-tallow) ammonium montmorillonite, and mixtures thereof.

In one embodiment, the plurality of alkyl tails includes a combination of short and long alkyl tails, wherein the short alkyl tails include between 1 and 7 carbon atoms, and wherein the long alkyl tails include greater than 7 carbon atoms. In another embodiment, the combination of short and long alkyl tails includes at least two long alkyl tails. In yet another embodiment, the at least one surfactant is dimethyl bis(hydrogenated-tallow) ammonium chloride.

In this aspect of the invention, the thermoplastic polymer may includes acid moieties, and wherein greater than 70 percent of the acid moieties are neutralized. In one embodiment, the acid moieties are present in the thermoplastic polymer in an amount between about 5 and 25 percent by weight of the thermoplastic polymer. In another embodiment, at least about 80 percent of the acid moieties are neutralized. In yet another embodiment, at least about 90 percent of the acid moieties are neutralized.

The present invention is also directed to a golf ball including a core and a cover, wherein the cover is formed from a composition including: an intercalated clay, wherein the clay has been organically modified through a reaction with at least one surfactant including a plurality of alkyl tails on an ammonium ion; and a thermoplastic polymer selected from the group including an ethylene-vinyl alcohol copolymer, a polyamide, an acid polymer, an ionomer, and a polyvinyl alcohol.

In one embodiment, the thermoplastic polymer is an acid polymer including between about 10 percent and about 20 percent acid moieties by weight of the acid polymer, and wherein greater than about 70 percent of the acid moieties are neutralized. In another embodiment, at least about 80 percent of the acid moieties are neutralized. In still another embodiment, the plurality of alkyl tails include a combination of short and long alkyl tails, and wherein the short alkyl tails include between about 1 and 7 carbon atoms, and wherein the long alkyl tails include greater than about 7 carbon atoms. For example, the long alkyl tail includes between about 12 and 18 carbon atoms. The at least one surfactant may be dimethyl bis(hydrogenated-tallow) ammonium chloride.

The present invention is also related to a golf ball including: a core including polybutadiene; an intermediate layer disposed on the core; and a cover disposed on the intermediate layer, wherein at least one of the intermediate layer and the cover is formed from a composition including: an intercalated clay, wherein the clay has been organically modified through a reaction with at least one surfactant including at least two long alkyl tails on an ammonium ion, wherein the at least two long alkyl tails each include greater than about 7 carbon atoms; and a thermoplastic polymer including acid moieties, wherein greater than about 70 percent of the acid moieties are neutralized with a metal cation.

In one embodiment, at least about 80 percent of the acid moieties are neutralized. In another embodiment, at least about 90 percent of the acid moieties are neutralized. The intermediate layer or cover may be formed from the composition.

The present invention is also directed to a golf ball including a core and a cover, wherein the cover is formed from a composition including: a nanocomposite including an intercalated clay and at least one resin having a barrier property; and a polyolefin resin; and a compatibilizer. The intercalated clay in the nanocomposite may include a long chain organic modifier including greater than 7 carbon atoms.

In one embodiment, the polyolefin resin includes high density polyethylene, low density polyethylene, linear low density polyethylene, ethylene-propylene copolymers, metallocene polyethylene, polypropylene, or mixtures thereof. In another embodiment, the compatibilizer includes a compatibilizing agent and an intercalated clay. The intercalated clay may be organically modified.

In this aspect of the invention, the at least one resin may be selected from the group consisting of an ethylene-vinyl alcohol copolymer, a polyamide, an ionomer, a polyvinyl alcohol, and combinations thereof. In one embodiment, the at least one resin includes between about 5 and 25 percent acid moieties by weight of the resin, and wherein greater than about 70 percent of the acid moieties are neutralized.

The composition may include between about 0.5 to 60 parts by weight of the nanocomposite, about 40 to 96 parts by weight polyolefin resin, and about 1 to 30 parts by weight of a compatibilizer by weight of the composition.

The present invention also relates to a golf ball including a core and a cover, wherein the cover is formed from a composition including: a nanocomposite including an organically modified intercalated clay and at least one polymer; and a polyolefin resin; and a compatibilizer including a compatibilizing agent and an intercalated clay.

In one embodiment, the at least one polymer is selected from the group consisting of an ethylene-vinyl alcohol copolymer, a polyamide, an ionomer, a polyvinyl alcohol, and combinations thereof. In another embodiment, the organically modified intercalated clay has been organically modified through a reaction with at least one quaternary ammonium surfactant with multiple alkyl tails on the ammonium ion.

The compatibilizing agent may be selected the group consisting of an epoxy-modified polystyrene copolymer, an ethylene-ethylene anhydride-acrylic acid copolymer, an ethylene-ethyl acrylate copolymer, an ethylene-alkyl acrylate-acrylic acid copolymer, a maleic anhydride grafted high-density polyethylene, a maleic anhydride grafted linear low-density polyethylene, an ethylene-alkyl (meth)acrylate-(meth)acrylic acid copolymer, an ethylene-butyl acrylate copolymer, an ethylene-vinyl acetate copolymer, a maleic anhydride grafted ethylene-vinyl acetate copolymer, a maleic anhydride grafted ethylene propylene rubber, a maleic anhydride grafted ethylene propylene diene rubber, and combinations thereof. For example, the compatibilizing agent may be selected from the group consisting of a maleic anhydride grafted ethylene propylene rubber, a maleic anhydride grafted ethylene propylene diene rubber, and combinations thereof.

The composition may include about 2 to about 50 parts by weight of the nanocomposite, about 50 to 80 parts by weight of the polyolefin resin, and about 2 to about 25 parts by weight of the compatibilizer based on the total weight of the composition.

The present invention is also directed to a golf ball including: a core; and a cover, wherein at least one layer of the cover includes a composition including: about 40 to 96 parts by weight polyolefin resin; about 4 to 40 parts by weight of a nanocomposite, wherein the nanocomposite includes a polymer and an organically modified intercalated clay; and about 2 to 25 parts by weight of a compatibilizer, wherein the compatibilizer includes a compatibilizing agent and an intercalated clay.

In one embodiment, the polymer is selected from the group consisting of an ethylene-vinyl alcohol copolymer, a polyamide, an ionomer, a polyvinyl alcohol, and mixtures thereof. In another embodiment, the polyolefin resin is selected from the group consisting of high density polyethylene, low density polyethylene, linear low density polyethylene, ethylene-propylene copolymers, metallocene polyethylene, polypropylene, and mixtures thereof.

In this aspect of the invention, the organically modified intercalated clay may include at least two long chain alkyl tails including greater than 7 carbon atoms.

DETAILED DESCRIPTION OF THE INVENTION

The present invention relates to compositions for use in golf balls including at least one layer formed from, at least in part, a high moisture barrier nanocomposite. In particular, the compositions of the invention generally include a nanocomposite formed from an intercalated clay and a polymer that provides high moisture barrier properties. For example, the compositions of the invention may include at least one resin and an organically modified intercalated clay.

The organically modified clay is capable of increased exfoliation, which increases the surface area of interaction between the clay and the resin, thereby improving the barrier properties of the resulting nanocomposite. In particular, the finer the intercalated clay is exfoliated in the resin having a barrier property, the greater the surface area of interaction between the resin and the clay. As the level of interaction between the clay and resin increase, the barrier and mechanical properties of the resin improve. Accordingly, the ability to form a barrier to gas and liquid is maximized by compounding the resin having barrier properties and the intercalated clay, and dispersing the nano-sized intercalated clay in the resin. Additionally, this effect minimizes the amount of clay necessary to achieve an improved high moisture barrier nanocomposite.

And, because the selected polymer resin preferably has superior gas barrier properties, the amount of polymer resin in the composition is preferably minimized to control cost. Thus, the compositions of the invention may further include a polyolefin resin and a compatibilizer. A compatibilizer is added in order to improve the compatibility of the polyolefin resin and the nanocomposite. However, because conventional compatibilizers generally have poor barrier properties, the compatibilizer used herein is also compounded with an intercalated clay.

Because the nanocomposites of the invention have increased exfoliation and mechanical strength, as well as a resulting high moisture barrier, when used in a golf ball, the compositions of the invention are believed to increase moisture resistance and increase strength. As such, the compositions of the invention provide an alternative to materials that have processing, delamination, and stiffness issues when used in layers of golf balls and coatings for golf balls.

The compositions of the invention can be used with a variety of golf ball constructions. For example, the compositions of the invention may be used as a cover layer in a two-piece ball with a large core, an outer cover layer in a three-piece ball with a relatively thing inner cover layer, an intermediate layer in a three-piece ball, or inner cover layer in a golf ball having dual cover layers. In addition, the compositions of the invention may be used to form coatings for golf balls. The composition components, golf ball constructions, and layer and ball properties are discussed in greater detail below. Moreover, the present invention explores suitable methods of making the golf balls that are formed using the compositions in structural layers and/or coating layers.

The Compositions of the Invention

The compositions of the invention include high moisture barrier nanocomposite compositions for use in golf components. In particular, the compositions of the invention include at least one intercalated clay and at least one thermoplastic polymer to form a nanocomposite with a barrier property. Either the organic clay or polymer may be modified to provide higher levels of exfoliation, and thereby improve the barrier and mechanical properties of the nanocomposite itself, ultimately improving the barrier and mechanical properties of the golf ball. In particular, without being bound to any particular theory, it is believed that, when the intercalated clay is finely exfoliated in the resin, the resulting material has a barrier film, which ultimately improves the barrier property and mechanical property of the nanocomposite composition.

The compositions of the invention may also include a polyolefin resin, the nanocomposite with a barrier property, and a compatibilizer.

Nanocomposite with Barrier Property

As generally discussed above, the compositions of the invention may include a thermoplastic polymer and an intercalated clay to form a nanocomposite with a barrier property. The weight ratio of the resin having a barrier property to the intercalated clay in the nanocomposite is about 58.0:42.0 to 99.9:0.1, preferably about 85.0:15.0 to 99.0:1.0. If the ratio is greater than 99.9:0.1, the effect of the intercalated clay on the barrier property is negligible. The individual components of the compositions are discussed below and specific preparations of the nanocomposite are provided in the examples section.

Thermoplastic Polymer Component

Particularly suitable thermoplastic polymers include acid polymers having acidic groups or moieties at least partially neutralized with a conjugate base. For example, the acid polymer may be an ionomer. In addition, the thermoplastic polymer may be a polyamide, ethylene-vinyl alcohol, polyvinyl alcohol, and mixtures thereof.

The acid polymers of the present invention are generally homopolymers and copolymers of $\alpha,\beta$-ethylenically unsaturated mono- or dicarboxylic acids, including combinations thereof. The term "copolymer," as used herein, includes polymers having two types of monomers, those having three types of monomers, and those having more than three types of monomers. In one embodiment, suitable $\alpha,\beta$-ethylenically unsaturated mono- or dicarboxylic acids include (meth) acrylic acid, ethacrylic acid, maleic acid, crotonic acid, fumaric acid, itaconic acid. As used herein, "(meth) acrylic acid" includes methacrylic acid and/or acrylic acid. Likewise, "(meth)acrylate" includes methacrylate and/or acrylate.

In one embodiment, the acid polymers include copolymers of a $C_3$ to $C_8$ $\alpha,\beta$-ethylenically unsaturated mono- or dicarboxylic acid and ethylene, a $C_3$ to $C_6$ $\alpha$-olefin (optionally including a softening monomer), or a mixture thereof. For example, the acid polymers may be copolymers of ethylene and (meth) acrylic acid with a softening monomer. Specific acid-containing ethylene copolymers include ethylene/acrylic acid, ethylene/methacrylic acid, and mixtures thereof. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth) acrylic acid/n-butyl acrylate, ethylene/(meth)acrylic acid/ethyl acrylate, and ethylene/(meth)acrylic acid/methyl acrylate copolymers.

When a softening monomer is included, the resulting copolymer is referred to herein as an E/X/Y-type copolymer, wherein E is ethylene, X is a $C_3$ to $C_8$ $\alpha,\beta$-ethylenically unsaturated mono- or dicarboxylic acid, and Y is a softening monomer. The softening monomer may be an alkyl (meth) acrylate, wherein the alkyl groups have from 1 to 8 carbon atoms. Non-limiting examples of E/X/Y-type copolymers include those wherein X is (meth) acrylic acid and/or Y is selected from (meth)acrylate, n-butyl (meth)acrylate, isobutyl (meth)acrylate, methyl (meth)acrylate, and ethyl (meth) acrylate. In particular, suitable E/X/Y-type copolymers include, but are not limited to, ethylene/acrylic acid/n-butyl acrylate, ethylene/methacrylic acid/n-butyl acrylate, ethylene/acrylic acid/iso-butyl acrylate, ethylene/methacrylic acid/iso-butyl acrylate, ethylene/acrylic acid/n-butyl methacrylate, ethylene/methacrylic acid/methyl n-butyl methacrylate, ethylene/acrylic acid/methyl acrylate, ethylene/methacrylic acid/methyl acrylate, ethylene/acrylic acid/ethyl acrylate, ethylene/methacrylic acid/ethyl acrylate, ethylene/acrylic acid/methyl methacrylate, ethylene/methacrylic acid/methyl methacrylate, and mixtures thereof.

The amount of ethylene or $C_3$ to $C_6$ α-olefin in the acid copolymer is typically at least 15 weight percent, preferably at least 25 weight percent, more preferably least 40 weight percent, even more preferably at least 60 weight percent, and even more preferably from 80 weight percent to 85 weight percent, based on the total weight of the copolymer. The amount of $C_3$ to $C_8$ α,β-ethylenically unsaturated mono- or dicarboxylic acid in the acid copolymer is typically from 1 weight percent to 35 weight percent preferably from 5 weight percent to 30 weight percent, more preferably from 5 weight percent to 25 weight percent, even more preferably from 10 weight percent to 20 weight percent, and even more preferably 15 weight percent to 20 weight percent, based on the total weight of the copolymer. The amount of optional softening comonomer in the acid copolymer is typically from 0 weight percent to 50 weight percent, preferably from 5 weight percent to 40 weight percent, more preferably from 10 weight percent to 35 weight percent, and even more preferably from 20 weight percent to 30 weight percent, based on the total weight of the copolymer.

In one embodiment, the acid copolymer includes greater than about 16 percent acid groups by weight of the acid copolymer. In another embodiment, the acid content is between about 17 percent and about 30 percent by weight of the acid copolymer. In yet another embodiment, the acid copolymer includes between about 17 weight percent and about 25 percent by weight of the acid copolymer. In still another embodiment, the acid content of the acid copolymer is between about 18 weight percent and about 23 weight percent.

The acid polymers of the present invention can be direct copolymers wherein the polymer is polymerized by adding all monomers simultaneously, as described in, for example, U.S. Pat. No. 4,351,931, the entire disclosure of which is hereby incorporated herein by reference. Ionomers can be made from direct copolymers, as described in, for example, U.S. Pat. No. 3,264,272 to Rees, the entire disclosure of which is hereby incorporated herein by reference. Alternatively, the acid polymers of the present invention can be graft copolymers wherein a monomer is grafted onto an existing polymer, as described in, for example, U.S. Patent Application Publication No. 2002/0013413, the entire disclosure of which is hereby incorporated herein by reference.

Suitable cation sources include, but are not limited to, metal cations and salts thereof, organic amine compounds, ammonium, and combinations thereof. In one embodiment, the cation source includes a metal cation and/or a salt thereof, wherein the metal is preferably lithium, sodium, potassium, magnesium, calcium, barium, lead, tin, zinc, aluminum, manganese, nickel, chromium, copper, or a combination thereof. Particularly preferred metals are zinc, magnesium, lithium, sodium, and mixtures thereof. As known to those of ordinary skill in the art, the amount of cation used to neutralize the acid moieties in the acid polymer is determined based on the desired level of neutralization.

As such, Surlyn® ionomers, commercially available from E. I. du Pont de Nemours and Company and Iotek® ionomers, commercially available from ExxonMobil Chemical Company are suitable thermoplastic polymers for use in accordance with the present invention. In addition, any of the acid copolymers described in U.S. Patent Application Publication No. 2003/0130434, the entire disclosure of which is hereby incorporated herein by reference, may be used according to the invention. Furthermore, Hytrel® thermoplastic polyester elastomers, commercially available from E. I. du Pont de Nemours and Company are also contemplated for use as the thermoplastic polymer component in accordance with the invention.

In one embodiment, between about 10 percent and 70 percent of the acid groups in the polymer are neutralized. For example, about 20 percent to about 60 percent of the acid groups may be neutralized. In this aspect of the invention, between about 25 percent and about 65 percent of the acid goups may be neutralized. In another embodiment, between about 30 percent and 60 percent of the acid groups may be neutralized. The use of melt flow modifier may be employed to increase neutralization.

In another embodiment, the polymer is a highly neutralized polymer ("HNP") or fully neutralized polymer ("FNP"). As used herein, the term "highly neutralized polymer" and/or "HNP" refers to the acid polymer after greater than about 70 percent, preferably at least about 80 percent, more preferably at least about 90 percent, and even more preferably at least about 95 percent, of the acid groups thereof are neutralized by a cation source. The term "fully neutralized polymer" and/or "FNP" refers to acid polymers where 100 percent of the acid moieties have been neutralized with a cation source. Commercially available HNPs include, but are not limited to, HPF 1000 and HPF 2000 from E. I. du Pont de Nemours and Company. U.S. Pat. No. 6,756,436, incorporated by reference in its entirety, includes suitable highly neutralized polymers for use in accordance with the present invention.

In order to facilitate the higher neutralization level to greater than about 70 percent, the use of a suitable melt flow modifier may be added to the polymer. For example, fatty acids and their salts and non-ionic polymers with higher melt flow properties may be employed to increase neutralization of the acid groups in the polymer. Neutralization can be effected prior to, during, or after combining the acid polymer(s) with a melt flow modifier(s).

The HNPs and FNPs may be blended with additional thermoplastic and thermoset materials, including, but not limited to, ionomers, acid copolymers, engineering thermoplastics, fatty acid/salt-based highly neutralized polymers, polybutadienes, polyurethanes, polyesters, thermoplastic elastomers, and other conventional polymeric materials.

Suitable polyamides for use as the thermoplastic polymer component include, but not limited to, nylon 4.6, nylon 6, nylon 6.6, nylon 6.10, nylon 7, nylon 8, nylon 9, nylon 11, nylon 12, nylon 46, MXD6, amorphous polyamide, a copolymerized polyamide containing at least two of these, or a mixture of at least two of these. The amorphous polyamide refers to a polyamide having not having an endothermic crystalline melting peak when measured by a differential scanning calorimetry (DSC) (ASTM D-3417, 10.degree. C./min).

In general, a polyamide suitable for use with the present invention may be prepared using an diamine and dicarboxylic acid. Examples of the diamine include hexamethylenediamine, 2-methylpentamethylenediamine, 2,2,4-trimethylhexamethylenediamine, 2,4,4-trimethylhexamethylenediamine, bis(4-aminocyclohexyl)methane, 2,2-bis(4-aminocyclohexyl)isopropylidene, 1,4-diaminocyclohexane, 1,3-diaminocyclohexane, meta-xylenediamine, 1,5-diaminopentane, 1,4-diaminobutane, 1,3-diaminopropane, 2-ethyldiaminobutane, 1,4-diaminomethylcyclohexane, methanexylenediamine, alkyl-substituted or unsubstituted m-phenylenediamine and p-phenylenediamine, etc.

Examples of the dicarboxylic acid include alkyl-substituted or unsubstituted isophthalic acid, terephthalic acid, adipic acid, sebacic acid, butanedicarboxylic acid, etc.

The combination of an aliphatic diamine and an aliphatic dicarboxylic acid will result in the formation of general semi-crystalline polyamide (also referred to as crystalline nylon), and not an amorphous polyamide. However, as known to those of ordinary skill in the art, a polyamide prepared using aromatic diamine and aromatic dicarboxylic acid is not easily treated using a general melting process. Thus, amorphous polyamide is preferably prepared when one of diamine and dicarboxylic acid used is aromatic and the other is aliphatic. Aliphatic groups of the amorphous polyamide are preferably $C_1$-$C_{15}$ aliphatic or $C_4$-$C_8$ alicyclic alkyls. Aromatic groups of the amorphous polyamide are preferably substituted $C_1$-$C_6$ mono- or bicyclic aromatic groups. However, all the above amorphous polyamide is not preferable in the present invention. For example, metaxylenediamine adipamide is easily crystallized when heated during a thermal molding process or when oriented, therefore, it is not preferable.

Examples of suitable amorphous polyamides for use with the present invention include, but are not limited to, hexamethylenediamine isophthalamide, hexamethylene diamine isophthalamide/terephthalamide terpolymer having a ratio of isophthalic acid/terephthalic acid of 99/1 to 60/40, a mixture of 2,2,4- and 2,4,4-trimethylhexamethylenediamine terephthalamide, a copolymer of hexamethylenediamine or 2-methylpentamethylenediamine and an isophthalic acid, terephthalic acid or mixtures thereof. While polyamide based on hexamethylenediamine isophthalamide/terephthalamide, which has a high terephthalic acid content, is useful, it should be mixed with another diamine such as 2-methyldiaminopentane in order to produce an amorphous polyamide that can be processed. Pebax® thermoplastic polyether block amides, commercially available from Arkema Inc. are suitable for use with the present invention.

If an ethylene-vinyl alcohol copolymer is used as the resin in the nanocomposite, the content of ethylene in the ethylene-vinyl alcohol copolymer is preferably 10 to 50 mol percent.

Blends of ethylene-vinyl alcohol copolymer and polyvinyl alcohol are also contemplated for use as the resin.

Intercalated Clay

Depending on the specific embodiment of the invention, the intercalated clay may be used as in its original form or in an organically modified form. For example, when the intercalated clay is used to form a nanocomposite with a barrier property, the intercalated clay may be used in its original form or contain an organic material. Non-limiting examples of intercalated clays for use with the present invention include montmorillonite, bentonite, kaolinite, mica, hectorite, fluorohectorite, saponite, beidelite, nontronite, stevensite, vermiculite, hallosite, volkonskoite, suconite, magadite, kenyalite, and mixtures thereof.

In one embodiment, the intercalated clay is preferably an organic intercalated clay. In particular, the content of an organic material in the intercalated clay is preferably 1 to 45 weight percent based on the total weight of the resulting organic intercalated clay. The organic material may have at least one functional group selected from the group consisting of from primary ammonium to quaternary ammonium, phosphonium, maleate, succinate, acrylate, benzylic hydrogen, oxazoline, dimethyldistearylammonium, and mixtures thereof.

In this aspect of the invention, the intercalated clay may be formed by a cation exchange reaction between an intercalated clay, e.g., sodium montmorillonite ($Na^+$-Mmt) and a tailed quaternary ammonium surfactant with multiple tails, such as dimethyl bis(hydrogenated-tallow) ammonium chloride. It has been shown that higher levels of exfoliation can be achieved using surfactants with multiple alkyl tails on the ammonium ion rather that just one tail. The presence of multiple long chain alkyl tails can result in an increased affinity for HNPs. The long chain alkyl tails also increase the area of the silicate surface shielded from the matrix. Moreover, without being bound to any particular theory, the use of long chain alkyl organic modifiers increases the gap size between the layers of the clay, which, in turn, is believed to affect the dispersion state of clays, exfoliation/intercalation in a polymer medium. Thus, in one embodiment, a long chain alkyl organic modifier includes between 12 and 18 carbon atoms.

The quaternary ammonium surfactant of the following structure:

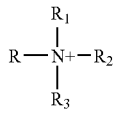

wherein R, $R_1$, $R_2$, and $R_3$ may be methyl groups, linear or branched aliphatics or aromatics. In the case of linear or branched aliphatics, they may be either short or long chain aliphatic groups, or a combination thereof, where a short chain contains between 1 and 7 carbon atoms, and a long chain contains greater than 7 carbon atoms. In particular, the organic intercalated clay may include both long chain alkyl organic modifiers and short chain alkyl organic modifiers.

The organic clay having long chain alkyl organic modifiers of the present invention may include methyl trihexadecyl ammonium montmorillonite and bis(2-hydroxy-ethyl)methyl ammonium montmorillonite and trimethyl tallow quaternary ammonium montmorillonite and methyl bis(hydrogenated-tallow) ammonium montmorillonite.

In another embodiment, the Na-Montmorillonite (Na-Mmt) was melt-intercalated with alkylamine and quaternized ammonium salts of sulfonated polystyrene ionomers (SPS).

Polyolefin/Nanocomposite/Compatibilizer

The compositions of the invention may also include a polyolefin resin and a compatibilizer. For example, in one embodiment, the nanocomposite with a barrier property described above may be dry blended with a polyolefin resin and a compatibilizer.

In this aspect of the invention, the components are preferably included in the following amounts: about 40 to 96 parts by weight of a polyolefin resin, preferably about 50 to 80 parts by weight of a polyolefin resin, and more preferably about 60 to about 75 parts by weight of a polyolefin resin; about 0.5 to 60 parts by weight of a nanocomposite having barrier properties, preferably about 2 to about 50 parts by weight of a nanocomposite having barrier properties, and more preferably about 4 to about 40 parts by weight of a nanocomposite having barrier properties; and about 1 to 30 parts by weight of a compatibilizer, preferably about 2 to about 25 parts by weight of a compatibilizer, and more preferably about 5 to about 20 parts by weight of a compatibilizer. Suitable polyolefin resins and compatibilizers for use in this aspect of the invention are discussed below.

Polyolefin Resin

Suitable polyolefin resins include high density polyethylene (HDPE), low density polyethylene (LDPE), linear low density polyethylene (LLDPE), ethylene-propylene copolymers, metallocene polyethylene, and polypropylene. The polypropylene may be at least one compound selected from the group consisting of a homopolymer of propylene, a copolymer of propylene, metallocene polypropylene and a composite resin having improved physical properties by adding talc, flame retardant, and the like to a homopolymer or copolymer of propylene.

Compatibilizer

The present embodiment may further include a compatibilizer. In one embodiment, the compatibilizer includes a compatibilizing agent. In another embodiment, the compatibilizer is the extruded product of a compatibilizing agent and an interclated clay. The compatibilizer reduces the brittleness of the polyolefin resin and improves the compatibility of the polyolefin resin with the nanocomposite having a barrier property to form a molded article with a stable structure.

Without being bound to any particular theory, a compatibilizing agent generally has chemical affinity to both the polyolefin resin and the nanocomposite having a barrier property, and thus improves the compatibility of the polyolefin resin in the nanocomposite to form a golf ball with a stable structure. However, since the compatibilizing agent alone includes a resin with a low molecular weight, it generally has a poorer barrier property than the polyolefin resin and the nanocomposite with a barrier property. Due to this drawback, an organic solvent or gas can penetrate the compatibilizing agent. Thus, the intercalated clay is added to the compatibilizing agent to improve its barrier properties.

The compatibilizing agent may be a hydrocarbon polymer having polar groups. When a hydrocarbon polymer having polar groups is used, the hydrocarbon polymer portion increases the affinity of the compatibilizer to the polyolefin resin and to the nanocomposite having barrier properties, thereby obtaining a golf ball with a stable structure.

The compatibilizing agent can include an compound selected from an epoxy-modified polystyrene copolymer, an ethylene-ethylene anhydride-acrylic acid copolymer, an ethylene-ethyl acrylate copolymer, an ethylene-alkyl acrylate-acrylic acid copolymer, a maleic anhydride modified (graft) high-density polyethylene, a maleic anhydride modified (graft) linear low-density polyethylene, an ethylene-alkyl (meth)acrylate-(meth)acrylic acid copolymer, an ethylene-butyl acrylate copolymer, an ethylene-vinyl acetate copolymer, a maleic anhydride modified (graft) ethylene-vinyl acetate copolymer, a maleic anhydride modified (graft) ethylene propylene rubber, a maleic anhydride modified (graft) ethylene propylene diene rubber, and combinations thereof.

In one embodiment, the compatibilizing agent is a maleic anhydride grafted metallocene single site catalyzed homo- or copolymer. In another embodiment, the compatibilizing agent is a polymer functionalized with at least one amine group, hydroxy group, cyano group, thiol group, silicone group, siloxane group, or a combination thereof. Examples of suitable compatibilizing agent of this type are disclosed in U.S. Pat. No. 5,919,862, the entire disclosure of which is incorporated by reference herein.

In yet another embodiment, the compatibilizing agent is selected from the group of modified ethylene acrylate carbon monoxide terpolymers, ethylene vinyl acetates (EVAs), polyethylenes, metallocene polyethylenes, ethylene propylene rubbers and polypropylenes commercially available from DuPont under the tradename Fusabond®.

The intercalated clay used to fowl the compatibilizer may be the same intercalated clay as used to prepare the nanocomposite having a barrier property. Thus, the intercalated clay may be in its original form or an organically modified form.

Blends

The compositions of the present invention may also be blended with other polymers. In particular, the compositions of the invention preferably include about 1 percent to about 100 percent of the nanocomposite with a barrier property or polyolefin/nanocomposite/compatibilizer. In one embodiment, the compositions contain about 10 percent to about 90 percent of the nanocomposite with a barrier property or polyolefin/nanocomposite/compatibilizer, preferably from about 10 percent to about 75 percent of the nanocomposite with a barrier property or polyolefin/nanocomposite/compatibilizer, and about 90 percent to 10 percent, more preferably from about 90 percent to about 25 percent of the second polymer component and/or other materials as described below. For example, a blend in accordance in the present invention may have about 10 percent to about 40 percent of the nanocomposite with a barrier property or polyolefin/nanocomposite/compatibilizer and about 60 percent to about 90 percent of another thermoplastic polymer, e.g., a conventional ionomer. In an alternate embodiment, a blend in accordance with the invention may include about 40 percent to about 80 percent of the nanocomposite with a barrier property or polyolefin/nanocomposite/compatibilizer and about 20 percent to about 60 percent of another thermoplastic polymer. Unless otherwise stated herein, all percentages are given in percent by weight of the total composition of the golf ball layer in question.

For example, the compositions of the invention may be present in a blend with ionomeric copolymers or terpolymers, ionomeric precursors, thermoplastics, polyamides, polycarbonates, polyesters, polyurethanes, polyureas, thermoplastic elastomers, polybutadiene rubber, balata, grafted and non-grafted metallocene-catalyzed polymers, single-site polymers, high-crystalline acid polymers, cationic polymers, cationic and anionic urethane ionomers and urethane epoxies, polyurethane ionomers, polyurea ionomers, epoxy resins, polyethylenes, polyacrylin, siloxanes, and mixtures thereof.

Examples of suitable urethane ionomers are disclosed in U.S. Pat. No. 5,692,974, the disclosure of which is hereby incorporated by reference in its entirety. Other examples of suitable polyurethanes are described in U.S. Pat. No. 5,334,673, the entire disclosure of which is incorporated by reference herein. Examples of suitable polyureas used to form the polyurea ionomer listed above are discussed in U.S. Pat. No. 5,484,870. In particular, the polyureas of U.S. Pat. No. 5,484,870 are prepared by reacting a polyisocyanate and a polyamine curing agent to yield polyurea, which are distinct from the polyureas of the present invention that are formed from a polyurea prepolymer and curing agent. Examples of suitable polyurethanes cured with epoxy group containing curing agents are disclosed in U.S. Pat. No. 5,908,358. The disclosures of the above patents are incorporated herein by reference in their entirety.

One of ordinary skill in the art would be well aware of methods to blend these polymeric materials with the organically modified silicate of the invention to form a composition for use in golf ball layers.

Additives

The compositions of the invention may include a variety of additives. For example, the compositions of the invention may be foamed by the addition of the at least one physical or chemical blowing or foaming agent. The use of a foamed polymer allows the golf ball designer to adjust the density or mass distribution of the ball to adjust the angular moment of inertia, and, thus, the spin rate and performance of the ball.

Foamed materials also offer a potential cost savings due to the reduced use of polymeric material.

Blowing or foaming agents useful include, but are not limited to, organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the composition during the injection molding process.

Additionally, a foamed composition of the present invention may be formed by blending microspheres with the composition either during or before the molding process. Polymeric, ceramic, metal, and glass microspheres are useful in the invention, and may be solid or hollow and filled or unfilled. In particular, microspheres up to about 1000 micrometers in diameter are useful. Furthermore, the use of liquid nitrogen for foaming, as disclosed in U.S. Pat. No. 6,386,992, which is incorporated by reference herein, may produce highly uniform foamed compositions for use in the present invention.

Fillers may also be added to the compositions of the invention to affect rheological and mixing properties, the specific gravity (i.e., density-modifying fillers), the modulus, the tear strength, reinforcement, and the like. The fillers are generally inorganic, and suitable fillers include numerous metals, metal oxides and salts, such as zinc oxide and tin oxide, as well as barium sulfate, zinc sulfate, calcium carbonate, zinc carbonate, barium carbonate, clay, tungsten, tungsten carbide, an array of silicas, regrind (recycled core material typically ground to about 30 mesh particle), high-Mooney-viscosity rubber regrind, and mixtures thereof.

For example, the compositions of the invention can be reinforced by blending with a wide range of density-adjusting fillers, e.g., ceramics, glass spheres (solid or hollow, and filled or unfilled), and fibers, inorganic particles, and metal particles, such as metal flakes, metallic powders, oxides, and derivatives thereof, as is known to those with skill in the art. The selection of such filler(s) is dependent upon the type of golf ball desired, i.e., one-piece, two-piece, multi-component, or wound, as will be more fully detailed below. Generally, the filler will be inorganic, having a density of greater than 4 g/cc, and will be present in amounts between about 5 and about 65 weight percent based on the total weight of the polymer components included in the layer(s) in question. Examples of useful fillers include zinc oxide, barium sulfate, calcium oxide, calcium carbonate, and silica, as well as other known corresponding salts and oxides thereof.

Additional materials conventionally included in other golf ball compositions may also be included in the compositions of the invention. For example, antioxidants, stabilizers, softening agents, plasticizers, including internal and external plasticizers, reinforcing materials, and compatibilizers may also be added to any composition of the invention. Those of ordinary skill in the art are aware of the purpose of these additives and the amounts that should be employed to fulfill those purposes.

Golf Ball Construction

As discussed briefly above, the compositions of the present invention may be used with any type of ball construction including, but not limited to, one-piece, two-piece, three-piece, and four-piece designs, a double core, a double cover, an intermediate layer(s), a multilayer core, and/or a multilayer cover depending on the type of performance desired of the ball. That is, the compositions of the invention may be used in a core, an intermediate layer, and/or a cover of a golf ball, each of which may have a single layer or multiple layers.

As used herein, the term "multilayer" means at least two layers. For instance, the core may be a one-piece core or a multilayer core, i.e., a core that has an innermost component with an additional core layer or additional core layers disposed thereon. As used herein, the terms "core" and "center" are generally used interchangeably to reference the innermost component of the ball. In some embodiments, however, the term "center" is used when there are multiple core layers, i.e., a center and an outer core layer.

When the golf ball of the present invention includes an intermediate layer, which may also include more than one layer, this layer may be incorporated with a single or multilayer cover, a single or multi-piece core, with both a single layer cover and core, or with both a multilayer cover and a multilayer core. The intermediate layer may be also be referred to as an inner cover layer or outer core layer, or any other layer(s) disposed between the inner core and the outer cover of a golf ball.

Golf Ball Core Layer(s)

The cores of the golf balls formed according to the invention may be solid, semi-solid, hollow, fluid-filled or powder-filled, one-piece or multi-component cores. As used herein, the term "fluid" includes a liquid, a paste, a gel, a gas, or any combination thereof; the term "fluid-filled" includes hollow centers or cores; and the term "semi-solid" refers to a paste, a gel, or the like.

The core may be formed from the compositions of the invention. For example, a core formed from the composition of the invention may be covered with a castable thermoset or injection moldable thermoplastic material or any of the other cover materials discussed below. The core may have a diameter of about 1.5 inches to about 1.62 inches and the cover layer thickness may range from about 0.03 inches to about 0.06 inches. The core compression preferably ranges from about 30 to about 120 atti and the overall ball compression is about 50 to about 110.

When not formed from the compositions of the invention, any core material known to one of ordinary skill in that art is suitable for use in the golf balls of the invention. Suitable core materials include thermoset materials, such as rubber, styrene butadiene, polybutadiene, isoprene, polyisoprene, trans-isoprene, as well as thermoplastics such as ionomer resins, polyamides or polyesters, and thermoplastic and thermoset polyurethane elastomers. For example, butadiene rubber, which, in an uncured state, typically has a Mooney viscosity (measured according to ASTM D1646-99) greater than about 20, preferably greater than about 30, and more preferably greater than about 40, may be used in one or more core layers of the golf balls prepared according to the present invention. In addition, the compositions of the invention may be incorporated the core.

Golf Ball Intermediate Layer(s)

An intermediate layer, such as an outer core layer or inner cover layer, i.e., any layer(s) disposed between the inner core and the outer cover of a golf ball may be fix filed from the compositions of the current invention. Such an intermediate layer may be distinguished from a core or a cover by some difference between the golf ball layers, e.g., hardness, compression, thickness, etc. An intermediate layer may be used, if desired, with a multilayer cover or a multilayer core, or with both a multilayer cover and a multilayer core. As with the core, the intermediate layer may also include a plurality of layers.

In one embodiment, the intermediate layer is formed, at least in part from the compositions of the invention. For example, an intermediate layer or inner cover layer having a thickness of about 0.015 inches to about 0.06 inches may be disposed about a core. In this aspect of the invention, the core, which has a diameter ranging from about 1.5 inches to about 1.59 inches, may also be formed from a composition of the invention or, in the alternative, from a conventional rubber composition. The inner ball may be covered by a castable thermoset or injection moldable thermoplastic material or any of the other cover materials discussed below. In this aspect of the invention, the cover may have a thickness of about 0.02 inches to about 0.045 inches, preferably about 0.025 inches to about 0.04 inches. The core compression is about 30 to about 110 atti, preferably about 50 to about 100 atti, and the overall ball compression preferably ranges from about 50 to about 100 atti.

In another embodiment, the intermediate layer is covered by an inner cover layer, either of which may independently be formed from the compositions of the invention. For example, a ball of the invention may include a center having a diameter of about 0.5 inches to about 1.30 inches and a compression of about 30 to about 110 atti, preferably about 50 to about 100 atti. The center may be formed from a composition of the invention or any of the other core materials previously discussed. The core may be covered by an outer core layer to form a core, which also may be formed form the compositions of the invention, any of the core materials discussed above, or castable thermoset materials or injection moldable thermoplastic materials. The outer core layer may have a thickness of about 0.125 inches to about 0.500 inches. The core may then be covered with a casing layer having a thickness of about 0.015 inches to about 0.06 inches formed from a composition of the invention, a castable thermoset material or an injection moldable thermoplastic material. The outer cover layer, which preferably has a thickness of about 0.02 inches to about 0.045 inches, may be formed from a castable thermoset material or an injection moldable thermoplastic material or other suitable cover materials discussed below and known in the art.

When not formed from the compositions of the invention, the intermediate layer(s) may also be formed, at least in part, from one or more homopolymeric or copolymeric materials, such as ionomers, primarily or fully non-ionomeric thermoplastic materials, vinyl resins, polyolefins, polyurethanes, polyureas, such as those disclosed in U.S. Pat. No. 5,484,870, polyamides, acrylic resins and blends thereof, olefinic thermoplastic rubbers, block copolymers of styrene and butadiene, isoprene or ethylene-butylene rubber, copoly(ether-amide), such as PEBAX, sold by Arkema, Inc. of Philadelphia, Pa., polyphenylene oxide resins or blends thereof, and thermoplastic polyesters.

For example, the intermediate layer may be formed of low acid ionomers, such as those described in U.S. Pat. Nos. 6,506,130 and 6,503,156, high acid ionomers, highly neutralized polymers, such as those disclosed in U.S. Patent Publication Nos. 2001/0018375 and 2001/0019971, or mixtures thereof. The intermediate layer may also be formed from the compositions as disclosed in U.S. Pat. No. 5,688,191. The entire disclosures of these patents and publications are incorporated herein by express reference thereto.

The intermediate layer may also include a wound layer formed from a tensioned thread material. The thread may be single-ply or may include two or more plies. Suitable thread materials include, but are not limited to, fiber, glass, carbon, polyether urea, polyether block copolymers, polyester urea, polyester block copolymers, syndiotactic- or isotactic-poly (propylene), polyethylene, polyamide, poly(oxymethylene), polyketone, poly(ethylene terephthalate), poly(p-phenylene terephthalamide), poly(acrylonitrile), diaminodicyclohexylmethane, dodecanedicarboxylic acid, natural rubber, polyisoprene rubber, styrene-butadiene copolymers, styrene-propylene-diene copolymers, another synthetic rubber, or block, graft, random, alternating, brush, multi-arm star, branched, or dendritic copolymers, or mixtures thereof. Those of ordinary skill in the art are aware of the process for producing thread materials for use with the present invention.

Golf Ball Cover Layer(s)

The cover provides the interface between the ball and a club. Properties that are desirable for the cover are good moldability, high moisture resistance, high abrasion resistance, high impact resistance, high tear strength, high resilience, and good mold release, among others. The cover layer may be formed, at least in part, from a composition of the invention. For example, the present invention contemplates a golf ball having a large core of polybutadiene and a thin cover formed from the composition of the invention.

When the compositions of the invention are incorporated into a core or intermediate/inner cover layer, however, the cover may be formed from one or more homopolymeric or copolymeric materials as discussed in the section above pertaining to the intermediate layer. Golf balls according to the invention may also be formed having a cover of polyurethane, polyurea, and polybutadiene materials discussed in U.S. Pat. No. 6,835,794.

For example, in one embodiment, the cover may be formed of a polyurethane. In this aspect of the invention, the polyurethane material may formed from a polyurethane prepolymer, e.g., the reaction product of an isocyanate and a hydroxy-terminated component, and a curing agent. The curing agent may be a hydroxy-terminated curing agent, an amine-terminated curing agent, or a mixture thereof. In one embodiment, the material includes only urethane linkages and, thus, the curing agent is a hydroxy-terminated curing agent.

For example, in another embodiment, the cover may be formed of a polyurea. In this aspect of the invention, the polyurea material may formed from a polyurea prepolymer, e.g., the reaction product of an isocyanate and an amine-terminated component, and a curing agent. The curing agent may be an amine-terminated curing agent, a hydroxy-terminated curing agent, or a mixture thereof. In one embodiment, the material includes only urea linkages and, thus, the curing agent is an amine-terminated curing agent.

As known to those of ordinary skill in the art, polyurethane and polyurea materials may be thermoplastic or thermoset materials depending on the ratio of the isocyanate-containing component to the isocyanate-reactive component. As such, in one embodiment, the cover is formed from a thermoplastic polyurethane material. In another embodiment, the cover is formed from a thermoplastic polyurea material. In yet another embodiment, the cover is formed from a castable reactive liquid material including urethane linkages. In still another embodiment, the cover is formed from a castable reactive liquid material including urea linkages.

Layer Formation

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, such as the compositions of the invention, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entirety.

The cores of the invention may be formed by any suitable method known to those of ordinary skill in art. When the cores are formed from a thermoset material, compression molding is a particularly suitable method of forming the core. In a thermoplastic core embodiment, on the other hand, the cores may be injection molded. Furthermore, U.S. Pat. Nos. 6,180,040 and 6,180,722 disclose methods of preparing dual core golf balls. The disclosures of these patents are hereby incorporated by reference in their entirety.

The intermediate layer and/or cover layer may also be formed using any suitable method known to those of ordinary skill in the art. For example, an intermediate layer may be formed by blow molding and covered with a dimpled cover layer formed by injection molding, compression molding, casting, vacuum forming, powder coating, and the like. And, when a golf ball includes a cover layer formed from a composition of the invention, the nanocomposite with a barrier property and polyolefin and compatibilizer may be dry-blended and fed into an injection molding machine to produce half cups. In particular, as discussed above, the nanocomposite with a barrier property may be formed by melt blending and extruding the components with polymer mixing equipment, such as a single or twin-screw extruder. The pellets produced may be dry blended with a polyolefin and a compatibilizer and then injection molded onto an inner ball. Compression molding or retractable pin injection molding may be used to seal the cups together and form a finished golf ball.

Golf Ball Post-Processing

The golf balls of the present invention may be painted, coated, or surface treated for further benefits. For example, golf balls may be coated with urethanes, urethane hybrids, ureas, urea hybrids, epoxies, polyesters, acrylics, or combinations thereof in order to obtain an extremely smooth, tack-free surface. If desired, more than one coating layer can be used. The coating layer(s) may be applied by any suitable method known to those of ordinary skill in the art. In one embodiment, the coating layer(s) is applied to the golf ball cover by an in-mold coating process, such as described in U.S. Pat. No. 5,849,168, which is incorporated in its entirety by reference herein.

Any of the golf ball layers may be surface treated by conventional methods including blasting, mechanical abrasion, corona discharge, plasma treatment, and the like, and combinations thereof. In fact, because low surface energy, or surface tension, is a key feature of polysiloxanes, layers formed from the compositions of the invention may be surface treated according to U.S. Patent Publication No. 2003/0199337, the disclosure of which is incorporated in its entirety by reference herein.

Golf Ball Properties

The properties such as core diameter, intermediate layer and cover layer thickness, hardness, and compression have been found to effect play characteristics such as spin, initial velocity and feel of the present golf balls.

Component Dimensions

Dimensions of golf ball components, i.e., thickness and diameter, may vary depending on the desired properties. For the purposes of the invention, any layer thickness may be employed. For example, the present invention relates to golf balls of any size, although the golf ball preferably meets USGA standards of size and weight. While "The Rules of Golf" by the USGA dictate specifications that limit the size of a competition golf ball to more than 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches (43 mm) to about 1.740 inches (44 mm) is most preferred, however diameters anywhere in the range of from 1.700 to about 1.950 inches can be used.

Preferably, the overall diameter of the core and all intermediate layers is about 80 percent to about 98 percent of the overall diameter of the finished ball. The core may have a diameter ranging from about 0.09 inches to about 1.65 inches. In one embodiment, the diameter of the core of the present invention is about 1.2 inches to about 1.630 inches. For example, when part of a two-piece ball according to invention, the core may have a diameter ranging from about 1.5 inches to about 1.62 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches, preferably about 1.55 inches to about 1.60 inches. In one embodiment, the core diameter is about 1.59 inches or greater. In another embodiment, the diameter of the core is about 1.64 inches or less.

When the core includes an inner core layer and an outer core layer, the inner core layer is preferably about 0.5 inches or greater and the outer core layer preferably has a thickness of about 0.1 inches or greater. For example, when part of a multi-layer ball according to invention, the center may have a diameter ranging from about 0.5 inches to about 1.30 inches and the outer core layer may have a diameter ranging from about 0.12 inches to about 0.5 inches. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

The cover typically has a thickness to provide sufficient strength, good performance characteristics, and durability. In one embodiment, the cover thickness is from about 0.02 inches to about 0.12 inches, preferably about 0.1 inches or less. For example, when part of a two-piece ball according to invention, the cover may have a thickness ranging from about 0.03 inches to about 0.09 inches. In another embodiment, the cover thickness is about 0.05 inches or less, preferably from about 0.02 inches to about 0.05 inches, and more preferably about 0.02 inches and about 0.045 inches.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. For example, when part of a three-piece ball or multi-layer ball according to invention, the intermediate layer and/or inner cover layer may have a thickness ranging from about 0.015 inches to about 0.06 inches. In another embodiment, the intermediate layer thickness is about 0.05 inches or less, more preferably about 0.01 inches to about 0.045 inches.

Hardness

Solid spheres formed of the compositions of the invention preferably have a hardness of about 30 to about 60 Shore D, more preferably about 35 to about 55 Shore D, and even more preferably about 40 to about 50 Shore D. For example, in one embodiment, a solid sphere formed of the composition of the invention has a hardness ranging from about 42 to about 50 Shore D.

As such, golf ball layers fowled of the compositions also preferably have hardnesses in this range. For example, a golf ball layer formed of the composition of the invention may have a hardness less than about 60 Shore D. In one embodiment, the hardness is about 50 Shore D or less. In another embodiment, the hardness ranges from about 35 Shore D to about 50 Shore D, preferably from about 40 Shore D to about 50 Shore D. Because the compositions of the invention may be used in any layer of a golf ball, the golf ball construction, physical properties, and resulting performance may vary greatly depending on the layer(s) of the ball that include the compositions of the invention.

The cores included in golf balls of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D. For example, when a core is formed from the composition of the invention, the core may have a hardness of about 40 Shore to about 50 Shore D.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. For example, when an intermediate layer is formed from the compositions of the invention, the hardness of the intermediate layer may be about 50 Shore D or less, preferably ranging from about 35 Shore D to about 50 Shore D. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater. For example, a golf ball of the invention may include an inner cover formed from a rosin-modified polymeric composition of the invention having a hardness of about 60 Shore D to about 75 Shore D.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

For example, when the intermediate layer is intended to be the hardest point in the ball, e.g., about 60 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

Compression

Compression is an important factor in golf ball design. For example, the compression of the core can affect the spin rate of the ball off the driver, as well as the feel of the ball when struck with the club. As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton.

As known to those of ordinary skill in the art, compression values are dependent on the diameter of the component being measured. The Atti compression of the core, or portion of the core, of golf balls prepared according to the invention may range from about 30 to about 110 atti, preferably about 50 to about 100 atti. In one embodiment, the core compression is less than about 80, preferably less than about 75. In another embodiment, the core compression is from about 40 to about 80, preferably from about 50 to about 70. In yet another embodiment, the core compression is preferably below about 50, and more preferably below about 25.

In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 50 to 100. In yet another embodiment, the compression of the golf balls of the invention is about 75 or greater and about 95 or less. For example, a preferred golf ball of the invention may have a compression from about 80 to about 95.

Coefficient of Restitution

The present invention contemplates golf balls having CORs from about 0.700 to about 0.850 at an inbound velocity of about 125 ft/sec. In one embodiment, the COR is about 0.750 or greater, preferably about 0.780 or greater. In another embodiment, the ball has a COR of about 0.800 or greater. In yet another embodiment, the COR of the balls of the invention is about 0.800 to about 0.815.

Solid spheres (1.55 inches) formed of the compositions of the invention may have a COR of at least about 0.820, preferably at least about 0.830. For example, the COR of solid spheres formed from the compositions of the invention ranges from about 0.840 to about 0.860. In one embodiment, a solid sphere fowled from the composition of the invention has a COR of about 0.845 to about 0.855. In another embodiment, the COR of the solid sphere ranges from about 0.851 to about 0.856.

Alternatively, the maximum COR of the ball is one that does not cause the golf ball to exceed initial velocity requirements established by regulating entities such as the USGA. As used herein, the term "coefficient of restitution" (COR) is calculated by dividing the rebound velocity of the golf ball by the incoming velocity when a golf ball is shot out of an air cannon. The COR testing is conducted over a range of incoming velocities and determined at an inbound velocity of 125 ft/s. Another measure of this resilience is the "loss tangent," or tan δ, which is obtained when measuring the dynamic stiffness of an object. Loss tangent and terminology relating to such dynamic properties is typically described according to ASTM D4092-90. Thus, a lower loss tangent indicates a higher resiliency, thereby indicating a higher rebound capacity. Low loss tangent indicates that most of the energy imparted to a golf ball from the club is converted to dynamic energy, i.e., launch velocity and resulting longer distance. The rigidity or compressive stiffness of a golf ball may be measured, for example, by the dynamic stiffness. A higher dynamic stiffness indicates a higher compressive stiffness. To produce golf balls having a desirable compressive stiffness, the dynamic stiffness of the crosslinked material should be less than about 50,000 N/m at −50° C. Preferably, the dynamic stiffness should be between about 10,000 and 40,000 N/m at −50° C., more preferably, the dynamic stiffness should be between about 20,000 and 30,000 N/m at −50° C.

Moisture Vapor Transmission

The moisture vapor transmission of a golf ball portion formed from the compositions of the invention may be expressed in terms of absorption, e.g., weight gain or size gain over a period of time at a specific conditions, and transmission, e.g., moisture vapor transmission rate (MVTR) according to ASTM E96-00. MVTR refers to the mass of water vapor that diffused into a material of a given thickness per unit area per unit time at a specific temperature and humidity differential. For example, weight changes of a golf ball portion monitored over a period of seven weeks in 100 percent relative humidity and 72° F. help to demonstrate which balls have better water resistance. In one embodiment, the golf ball portions of the invention have a weight gain of about 15 grams per 100 $in^2$ per day or less at 38° C. and 90 percent relative humidity. In another embodiment, the golf balls of the invention have a weight gain of about 12.5 grams per 100 $in^2$ per day or less. In still another embodiment, the weight gain of the golf balls of the invention is about 7 grams per 100 $in^2$ per day or less. In yet another embodiment, the weight gain is about 5 grams per 100 $in^2$ per day or less. The golf balls of the invention preferably have a weight gain of about 3 grams per 100 $in^2$ per day or less.

Size gain may also be used as an indicator of water resistance. That is, the more water a golf ball takes on, the larger a golf ball becomes due to the water enclosed beneath the outermost layer of the golf ball portion. Thus, the golf balls of the invention preferably have no appreciable size gain. In one embodiment, the size gain of the golf balls of the invention after a seven-week period is about 0.001 inches or less.

EXAMPLES

It should be understood that the examples below are for illustrative purposes only. In no manner is the present invention limited to the specific disclosures therein.

Example 1

Nanocomposites Having a Barrier Property

Four different nanocomposites having barrier properties according to the invention are detailed below.

Nanocomposite Formulation 1:

97 weight percent of an ethylene-vinyl alcohol copolymer (EVOH; E105B (ethylene content: 44 mol percent, available from Kuraray Japan having a melt index of 5.5 g/10 min and a density of 1.14 g/$cm^3$) were fed into the main hopper of a twin screw extruder (180 to 200° C., 300 rpm). 3 weight percent of organic montmorillonite (Closite 20A from Southern Intercalated Clay Products, USA) and 0.1 part by weight of a thermal stabilizer (Irganox® 1098 from Ciba) based on total 100 parts by weight of EVOH copolymer and the organic montmorillonite were fed into the side feeder of the twin screw extruder to prepare a nanocomposite having a barrier property.

Nanocomposite Formulation 2:

97 weight percent of a polyamide (nylon 6) was fed into the main hopper of a twin screw extruder (220 to 245° C., 300 rpm). 3 weight percent of organic montmorillonite and 0.1 part by weight of a thermal stabilizer (Irganox® 1098 from Ciba) based on total 100 parts by weight of a polyamide and the organic montmorillonite were separately fed into the side feeder of the twin screw extruder to prepare a nanocomposite having a barrier property.

Nanocomposite Formulation 3:

97 weight percent of HPF 2000 was fed into the main hopper of a twin screw extruder (220 to 245° C., 300 rpm). 3 weight percent of organic montmorillonite and 0.1 part by weight of a thermal stabilizer (Irganox® 1098 from Ciba) based on total 100 parts by weight of the ionomer and the organic montmorillonite were separately fed into the side feeder of the twin screw extruder to prepare a nanocomposite having a barrier property.

The organic montmorillonite may be modified with long and short alkyl organic modifiers.

Nanocomposite Formulation 4:

97 weight percent of an ionomer Surlyn® 6910 was fed into the main hopper of a twin screw extruder (220 to 245° C., 300 rpm). 3 weight percent of organic montmorillonite and 0.1 part by weight of a thermal stabilizer (Irganox® 1098 from Ciba) based on total 100 parts by weight of the ionomer and the organic montmorillonite were separately fed into the side feeder of the twin screw extruder to prepare a nanocomposite having a barrier property.

Example 2

Golf Ball Covers Formed from Nanocomposites of the Invention

Golf ball covers may be formed using the nanocomposite formulations in Example 1. The nanocomposites may be fed into the main hopper of an injection molding machine to produce half cups. The half cups may then be compression molded about an inner ball. The covers may be an outer cover or an inner cover or both.

Example 3

Polyolefin/Nanocomposite/Compatibilizers Blends of the Invention

After forming a compatibilizer, the nanocomposites from Example 1 and a polyolefin may be dry-blended, injection molded, and compression molded or subjected to retractable pin injection molding (RPIM) to form golf ball covers.

Compatibilizer 97 weight percent of a compatibilizing agent (e.g., maleic anhydride grafted ethylene propylene rubber, maleic anhydride grafted ethylene propylene diene rubber, or a terpolymer of ethylene-acrylic acid-maleic anhydride) may be fed into the main hopper of a twin screw extruder (155 to 175° C., 300 rpm). 3 weight percent of organic montmorillonite and 0.1 part by weight of a thermal stabilizer (IR 1098) based on total 100 parts by weight of the compatibilizing agent and the organic montmorillonite may be separately fed into the side feeder of the twin screw extruder to prepare a pellet form of the compatibilizer.

Composition 1

25 parts by weight of the Nanocomposite Formulation 1 prepared in Example 1, 5 parts by weight of the compatibilizer, and 70 parts by weight of an HDPE may be dry-blended and fed into a main hopper of an injection molding machine to produce a golf ball component either by producing half-cups followed by compression molding or by RPIM processing for testing.

Composition 2

25 parts by weight of the Nanocomposite Formulation 2, 5 parts by weight of the compatibilizer, and 70 parts by weight of an HDPE may be dry-blended and fed into a main hopper of an injection molding machine to produce a golf ball component either by producing half-cups followed by compression molding or by RPIM processing for testing.

Composition 3

4 parts by weight of the Nanocomposite Formulation 2, 2 parts by weight of the compatibilizer, and 94 parts by weight of an HDPE may be dry-blended and fed into a main hopper of an injection molding machine to produce a golf ball component either by producing half-cups followed by compression molding or by RPIM processing for testing.

Composition 4

40 parts by weight of the Nanocomposite Formulation 2, 20 parts by weight of the compatibilizer, and 40 parts by weight of an HDPE may be dry-blended and fed into a main hopper of an injection molding machine to produce a golf ball component either by producing half-cups followed by compression molding or by RPIM processing for testing.

Composition 5

25 parts by weight of the Nanocomposite Formulation 3 prepared in Example 1, 5 parts by weight of the compatibilizer, and 70 parts by weight of an HDPE may be dry-blended and fed into a main hopper of an injection molding machine to produce a golf ball component either by producing half-cups followed by compression molding or by RPIM processing for testing.

Composition 6

25 parts by weight of the Nanocomposite Formulation 4 prepared in Example 1, 5 parts by weight of the compatibilizer, and 70 parts by weight of an HDPE may be dry-blended and fed into a main hopper of an injection molding machine to produce a golf ball component either by producing half-cups followed by compression molding or by RPIM processing for testing.

Other than in the operating examples, or unless otherwise expressly specified, all of the numerical ranges, amounts, values and percentages such as those for amounts of materials, times and temperatures of reaction, ratios of amounts, values for molecular weight (whether number average molecular weight ("Mn") or weight average molecular weight ("Mw"), and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. For example, the compositions of the invention may also be used in golf equipment such as putter inserts, golf club heads and portions thereof, golf shoe portions, and golf bag portions. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball comprising a core and a cover, wherein the cover is formed from a composition comprising:

an intercalated clay, wherein the clay has been organically modified through a reaction with at least one surfactant comprising a plurality of alkyl tails on an ammonium ion; and a thermoplastic polymer.

2. The golf ball of claim 1, wherein the intercalated clay is selected from the group comprising a methyl trihexadecyl ammonium montmorillonite, bis(2-hydroxy-ethyl)methyl ammonium montmorillonite, trimethyl tallow quaternary ammonium montmorillonite, methyl bis(hydrogenated-tallow) ammonium montmorillonite, and mixtures thereof.

3. The golf club of claim 1, wherein the plurality of alkyl tails comprises a combination of short and long alkyl tails, wherein the short alkyl tails comprise between 1 and 7 carbon atoms, and wherein the long alkyl tails comprise greater than 7 carbon atoms.

4. The golf club of claim 1, wherein the combination of short and long alkyl tails comprises at least two long alkyl tails.

5. The golf ball of claim 1, wherein the at least one surfactant is dimethyl bis(hydrogenated-tallow) ammonium chloride.

6. The golf ball of claim 1, wherein the thermoplastic polymer comprises acid moieties, and wherein greater than 70 percent of the acid moieties are neutralized.

7. The golf ball of claim 6, wherein the acid moieties are present in the thermoplastic polymer in an amount between about 5 and 25 percent by weight of thermoplastic polymer.

8. The golf ball of claim 6, wherein at least about 80 percent of the acid moieties are neutralized.

9. The golf ball of claim 7, wherein at least about 90 percent of the acid moieties are neutralized.

10. A golf ball comprising a core and a cover, wherein the cover is formed from a composition comprising:

an intercalated clay, wherein the clay has been organically modified through a reaction with at least one surfactant comprising a plurality of alkyl tails on an ammonium ion; and a thermoplastic polymer selected from the group comprising an ethylene-vinyl alcohol copolymer, a polyamide, an acid polymer, an ionomer, and a polyvinyl alcohol.

11. The golf ball of claim 10, wherein the thermoplastic polymer is an acid polymer comprising between about 10 percent and about 20 percent acid moieties by weight of the acid polymer, and wherein greater than about 70 percent of the acid moieties are neutralized.

12. The golf ball of claim 11, wherein at least about 80 percent of the acid moieties are neutralized.

13. The golf ball of claim 10, wherein the plurality of alkyl tails comprise a combination of short and long alkyl tails, and wherein the short alkyl tails comprise between about 1 and 7 carbon atoms, and wherein the long alkyl tails comprise greater than about 7 carbon atoms.

14. The golf ball of claim 13, wherein the long alkyl tail comprises between about 12 and 18 carbon atoms.

15. The golf ball of claim 10, wherein the at least one surfactant comprises dimethyl bis(hydrogenated-tallow) ammonium chloride.

16. A golf ball comprising:

a core comprising polybutadiene;

an intermediate layer disposed on the core; and a cover disposed on the intermediate layer, wherein at least one of the intermediate layer and the cover is formed from a composition comprising:

an intercalated clay, wherein the clay has been organically modified through a reaction with at least one surfactant comprising at least two long alkyl tails on an ammonium ion, wherein the at least two long alkyl tails each comprise greater than about 7 carbon atoms; and a thermoplastic polymer comprising acid moieties, wherein greater than about 70 percent of the acid moieties are neutralized with a metal cation.

17. The golf ball of claim 16, wherein at least about 80 percent of the acid moieties are neutralized.

18. The golf ball of claim 17, wherein at least about 90 percent of the acid moieties are neutralized.

19. The golf ball of claim 16, wherein the intermediate layer is fowled from the composition.

20. The golf ball of claim 16, wherein the cover is formed from the composition.

* * * * *

UNITED STATES PATENT AND TRADEMARK OFFICE

CERTIFICATE OF CORRECTION

PATENT NO. : 7,695,381 B1
APPLICATION NO. : 12/333877
DATED : April 13, 2010
INVENTOR(S) : Michael J. Sullivan and Murali Rajagopalan It is certified that error appears in the above-identified patent and that said Letters Patent is hereby corrected as shown below:

On the title page under "Related U.S. Application Data", the data should be inserted to reflect as follows:

-- This application is a CON of 12/333,767 12/12/2008 --

Signed and Sealed this

Twenty-second Day of June, 2010

David J. Kappos

David J. Kappos
*Director of the United States Patent and Trademark Office*